US010149040B2

(12) United States Patent
Birath

(10) Patent No.: US 10,149,040 B2
(45) Date of Patent: Dec. 4, 2018

(54) AUDIO LISTENING ARRANGEMENT

(71) Applicant: Zound Industries International AB, Stockholm (SE)

(72) Inventor: Martin Birath, Lidingö (SE)

(73) Assignee: Zound Industries International AB, Stockholm (SE)

( * ) Notice: Subject to any disclaimer, the term of this patent is extended or adjusted under 35 U.S.C. 154(b) by 0 days.

(21) Appl. No.: 15/147,723

(22) Filed: May 5, 2016

(65) Prior Publication Data

US 2016/0337746 A1 Nov. 17, 2016

(30) Foreign Application Priority Data

May 15, 2015 (SE) ..... 1550626

(51) Int. Cl.
*H04R 25/00* (2006.01)
*H04R 1/10* (2006.01)

(52) U.S. Cl.
CPC ..... *H04R 1/1066* (2013.01); *H04R 1/105* (2013.01); *H04R 1/1033* (2013.01)

(58) Field of Classification Search
CPC ..... H04R 1/1066; H04R 1/105; H04R 1/1033
USPC ..... 381/380, 381, 382; 455/41.3
See application file for complete search history.

(56) References Cited

U.S. PATENT DOCUMENTS 5,210,792 A * 5/1993 Kajihara ..... H04M 1/05 379/430
5,412,736 A * 5/1995 Keliiliki ..... H04R 1/105 381/330
5,457,751 A 10/1995 Such
5,757,944 A * 5/1998 Jensen ..... H04R 1/08 379/430
5,761,298 A * 6/1998 Davis ..... H04M 1/05 379/430

(Continued)

FOREIGN PATENT DOCUMENTS

EP 0994636 A2 4/2000
EP 2277321 1/2011

(Continued)

OTHER PUBLICATIONS

Extended European Search report in EP Application No. 16169107.6 dated Oct. 11, 2016.

(Continued)

*Primary Examiner* — Phylesha Dabney
(74) *Attorney, Agent, or Firm* — Knobbe Martens Olson & Bear LLP

(57) ABSTRACT

An audio listening arrangement comprising an audio listening device adapted to be placed in an ear of a user each, wherein the audio listening device comprises an inner side and an outer side, and an ear support for holding the audio listening device in the ear of a user, wherein the ear support comprises an elongated support portion extending along a first longitudinal axis and further adapted to rest on an upper part of an ear of a user, and an elongated leg which is interconnected with the elongated support portion by means of a first bend such that the elongated leg forms an acute angle with the elongated support portion, whereby the ear support is attached to the outer side of the audio listening device such that the elongated leg is inclined in direction of the inner side of the audio listening device.

20 Claims, 2 Drawing Sheets

(56) References Cited

U.S. PATENT DOCUMENTS

| | | | | |
|---|---|---|---|---|
| 6,104,824 | A | 8/2000 | Ito | |
| 6,195,441 | B1 | 2/2001 | Ito | |
| 6,449,374 | B1 * | 9/2002 | Skulley | H04R 1/083 381/330 |
| 6,580,800 | B1 | 6/2003 | Yamasaki et al. | |
| 6,584,208 | B2 * | 6/2003 | Cheng | H04R 1/083 381/374 |
| 6,810,987 | B1 * | 11/2004 | DeKalb | H04R 1/105 181/129 |
| 8,320,603 | B2 * | 11/2012 | Bass | H04R 1/10 381/330 |
| 8,761,431 | B1 | 6/2014 | Jackson | |
| 9,319,769 | B2 | 4/2016 | Burgett et al. | |
| 2003/0174853 | A1 * | 9/2003 | Howes | H04R 1/083 381/370 |
| 2007/0071269 | A1 | 3/2007 | Milde | |
| 2007/0248238 | A1 | 10/2007 | Abreu | |
| 2008/0144854 | A1 | 6/2008 | Abreu | |
| 2008/0264429 | A1 | 10/2008 | Leong et al. | |
| 2011/0123059 | A1 * | 5/2011 | Hu | H04R 1/1016 381/380 |
| 2011/0255729 | A1 * | 10/2011 | Tan | H04R 1/105 381/380 |
| 2013/0114842 | A1 | 5/2013 | Jennings | |
| 2013/0195310 | A1 | 8/2013 | Lin | |
| 2014/0185821 | A1 | 7/2014 | Ushakov | |
| 2014/0270317 | A1 | 9/2014 | Burgett et al. | |
| 2016/0279435 | A1 | 9/2016 | Hyde et al. | |

FOREIGN PATENT DOCUMENTS

| | | | |
|---|---|---|---|
| EP | 2611210 | A1 | 7/2013 |
| GB | 2484069 | | 4/2012 |
| KR | 20120017920 | A | 2/2012 |
| KR | 10-1159795 | | 6/2012 |
| KR | 101159795 | | 6/2012 |
| WO | WO 03/075608 | | 9/2003 |
| WO | WO 2014/051416 | | 4/2014 |

OTHER PUBLICATIONS

International Search Report in PCT Application No. PCT/SE2016/050421 dated Jun. 7, 2016.

Swedish Office Action issued in Patent Application No. 1550626-4, dated Nov. 12, 2015 (priority application).

Plantronics, Backbeat Fit User Guide, 2014, Plantronics Inc. pp. 1-16 (U.S. App. No. 15/153,616).

Ocakoglu et al., "The Shape of the External Human Ear: A Geometric Morphometric Study", 2013, TurkitiyeKliniKleri J Med Sci, pp. 184-190.

Swedish Office Action issued in Patent Application No. 1550627-2, dated Nov. 12, 2015.

Extended European Search report in EP Application No. 16169188.6 dated Oct. 12, 2016.

International Search Report in PCT Application No. PCT/SE2016/050423 dated Jun. 7, 2016.

* cited by examiner

AUDIO LISTENING ARRANGEMENT

INCORPORATION BY REFERENCE TO ANY PRIORITY APPLICATIONS

Any and all applications for which a foreign or domestic priority claim is identified in the Application Data Sheet as filed with the present application are hereby incorporated by reference under 37 CFR 1.57. For example, this application claims the benefit of priority to Swedish Patent Application No. 1550626-4, filed on May 15, 2015, the disclosure of which is hereby incorporated by reference in its entirety for all purposes.

BACKGROUND

Field

The present disclosure relates to an audio listening arrangement to be worn by a user e.g. when listening to audio content.

Description of the Related Art

A head set makes it possible for a wearer thereof to listen to audio content, such as music or radio broadcasts in environments or situations where it is unsuitable to play the audio content aloud, for example in public spaces where other people may be disturbed.

A simple form of a head set comprises one or two audio listening devices in the form of miniature loudspeakers or headphones which are attached to a support ribbon which is carried on the head of the user so that the loudspeakers are placed in close proximity to the ears of the user. The headset is typically connected to an audio source such as a cellular phone, a radio or an MP3-player.

Headsets may also be used in situations where the user is physically active. For example, a person performing sports may use a headset to listen to music while running or bicycling. Also police personnel or firefighters may use headsets as a component in a communication system.

A requirement of a headset for physical activities is that the audio listening devices remain in place in the ears of the user even during long and/or vigorous physical activity. Certain attempts have been made in the art to increase the stability of headsets.

One example of a headset is shown in the published patent application KR101159795 in which each audio listening device of the headset is attached to a hook-shaped support designed to surround the ear of the user. The hook-shaped support is elastic and bears against the rear part of the user's ear to increase the stability of the position of the audio listening device in the ear of the user. The hook-shaped support further extends into a ribbon which passes behind the neck of the user.

A drawback with the headset of KR1011597795 is that the holding function of the hook-shaped support is largely based on the contact with the rear of the user's ear. The hook-shaped support may therefore not be sufficiently effective. Moreover, the contact between the hook-shaped support and the rear part of the ear of the user may be uncomfortable, especially during longtime use. The head ribbon which interconnects the hook shaped supports may further be considered uncomfortable and less practical to the user, for example in combination with a hat or other head wear.

Thus, it is an object of the present disclosure to achieve an audio listening arrangement which solves or at least mitigates at least one of the above drawbacks with the prior-art.

In particular, it is an object of the present disclosure to achieve an audio listening arrangement comprising an improved ear support for holding the audio listening devices in the ear of a user. A further object of the present disclosure is to achieve an audio listening arrangement which may be worn independent of a head ribbon. A further object of the present disclosure is to achieve a light-weight and audio listening arrangement. Yet a further object of the present disclosure is to achieve a robust audio listening arrangement of simple construction which may be produced at low cost.

SUMMARY

According to a first aspect of the present disclosure at least one of these objects is achieved by an audio listening arrangement comprising an audio listening device adapted to be placed in an ear of a user each, wherein the audio listening device comprises an inner side and an outer side, and an ear support for holding the audio listening device in the ear of a user, wherein the ear support comprises:

- an elongated support portion extending along a first longitudinal axis (X1) and further adapted to rest on an upper part of an ear of a user, and
- an elongated leg which is interconnected with the elongated support portion by means of a first bend (B1) such that the elongated leg forms an acute angle (V1) with the elongated support portion, whereby the ear support is attached to the outer side of the audio listening device such that the elongated leg is inclined in direction of the inner side of the audio listening device.

The audio listening arrangement according to the present disclosure was initially intended to be part of a headset in which two audio listing arrangement are interconnected by a cord adapted to extend around the back of the head of the user. However, practical trials have surprisingly shown that when the audio listening arrangement is worn on the head of a user, the ear support is pressed firmly against the sides of the head of a user. This in turn causes the audio listening device to remain sufficiently securely in place in the ear of the user to allow the audio listening arrangement to be used separately, i.e. without being interconnected by a cord. This is true even during vigorous physical activity over long time.

The effective holding function of the audio listening arrangement according to the disclosure is believed to depend on a combinatory effect between, on one hand, the inclination of the ear support towards the head of the user and, on the other hand, the acute angle between the elongated upper support portion and the leg of ear support. The combinatory effect is believed to press the bend between the upper support portion and the elongated leg of the ear support into firm contact with the side of the head of the user.

According to one embodiment of the audio listening arrangement, an end portion of the ear support is interconnected with the elongated leg by a second bend B2 such that the elongated leg forms the second acute angle V2, with the end portion of the ear support. The second bend B2 increases the radial distance between elongated leg and the outer side of the audio listening device. This in turn makes it possible to increase the inclination of the ear support and thus the strong holding force against the head of the user.

According to a further embodiment, an end portion of the elongated leg of the ear support is directly attached to the outer side of the audio listening device. This allows for a simple construction and the possibility to produce the audio listening arrangement at low cost. Moreover, since the audio listening arrangement comprises few protruding parts there is less risk that the audio listening arrangement gets entangled in the hair or clothes of the user.

According to an embodiment, at least the first bend B1 of the ear support may be manufactured from a resilient material, preferably a rubber material. By making a portion of the ear support in resilient material the ear support becomes more flexible, which has several advantages. For example, the resiliency makes the ear support to abut more strongly against the head of the user. A further advantage is that the resilient bend B1 allows the audio listening arrangement to be used on different head sizes.

According to an embodiment, at least a portion of the inner side of the audio listening device is adapted to be placed in contact with the concha of an ear of the user whereby the inner side of the audio listening device comprises an audio conducting means for conducting audio signals emitted from a transducer in the audio listening device into the ear canal of the user. Practical trials have shown that an excellent holding effect of the audio receiving devices in the ears the user is achieved when the audio listening device has this configuration.

According to an embodiment, the audio listening device may comprise a loop for abutment against the ear of the ear of a user. The loop fixes the audio listening device even more firmly in the ear of the user.

DETAILED DESCRIPTION

The audio listening arrangement according to the present disclosure will now be described more fully hereinafter. The audio listening arrangement according to the present disclosure may, however, be embodied in many different forms and should not be construed as limited to the embodiments set forth herein; rather, these embodiments are provided by way of example so that this disclosure will be thorough and complete, and will fully convey the scope of the present disclosure to those persons skilled in the art. Like reference numbers refer to like elements throughout the description.

Figure 1:
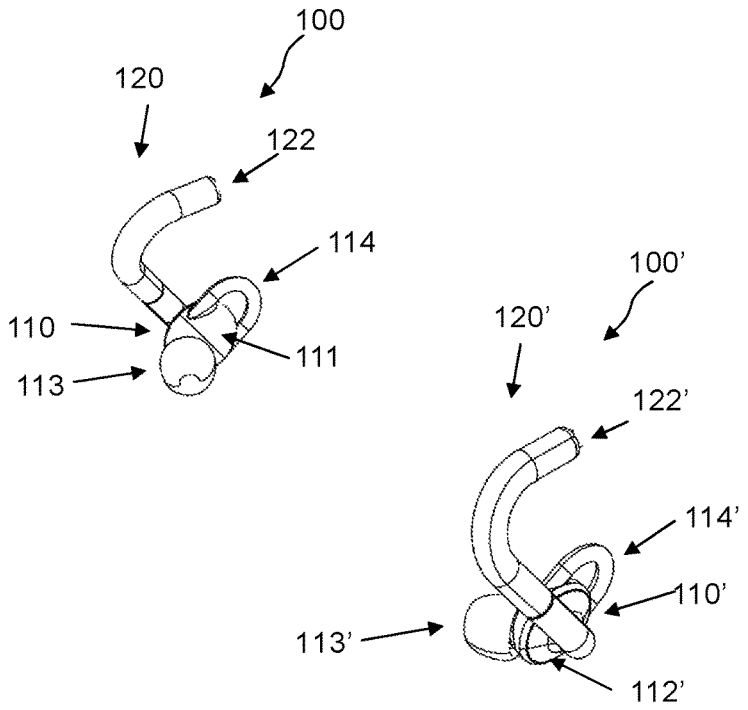
FIG. 1: A schematically perspective drawing of a set of two audio listening arrangements according to a first embodiment of the present disclosure.

FIG. 1 shows schematically a set of two audio listening arrangements 100, 100' according to the disclosure. The audio arrangements 100, 100' are identical so therefore only the audio arrangement 100 will be described in detail in the following, and the audio arrangement 100' may have analogous features with the same numerals but with an apostrophe (') after the numeral. The audio listening arrangement 100 comprises an audio listening device 110 adapted to be placed in the ear of a user. The audio listening device 110 may comprise a transducer (not shown in the drawing). The transducer, which is enclosed within the audio listening device, may be of any type of electric or electronic device capable of receiving electrical signals from a source, and convert the electric signals into acoustic signals, i.e. sound. For example, the transducer may comprise an electro-acoustic transducer, such as a loudspeaker. The transducer may be connected (not show), by an electrical wire, to a device for transmitting and receiving wireless signals from an electronic audio source, such as a smart phone. The wireless communication between the receiving device and the source is preferably achieved by blue-tooth.

The audio listening device 110 has an inner side 111 which is facing the ear when the audio listening device is placed in the ear of the user. More particularly, at least a portion of the inner side 111 of the audio listening device 110 is adapted to be supported against the concha of the ear of the user. Therefore, the inner side 111, or inner surface 111, is preferably flat. The inner side 111 of the audio listening device 110 further comprises an audio conducting means 113 which is adapted to conduct audio signals emitted from the transducer 110 of the audio listening device 110 into the ear canal of the user of the audio listening arrangement. The audio conducting means 113 may for example be an in-ear ear plug, as shown in FIG. 1. An in-ear plug is adapted to extend into the ear canal of the user of the audio listening arrangement and generally provides good sound transmission as well as being comfortable during use. Alternatively, the audio conducting means 113 may be an ear bud (not shows in the drawing). An ear bud is typically adapted to rest at the entrance of the ear canal of the user of the audio listening arrangement.

The audio listening device 110 may further be provided with a loop 114 which is arranged to abut the ear of the user. When the audio listening device is inserted in the ear of the user, the loop abuts the antihelix of the ear. The loop 114, which is preferably flexible and manufactured from a resilient material such as rubber, may provide extra stability of the audio listening device in the ear of a user. As shown in FIG. 1, the loop 114 extends from the inner surface 111 of the audio listening device 110.

The audio listening device 110 further has an outer side 112, which is opposite to the inner side 111 and thus directed radially away from the head of the user.

The audio listening device 110 further comprises an ear support 120 for holding the audio listening device 110 in place in the ear of a user.

Figure 3:
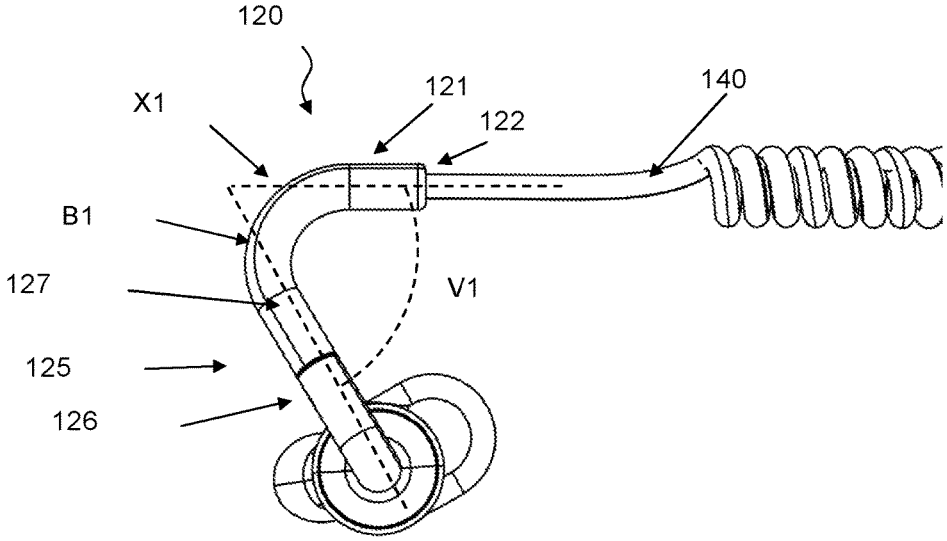
FIG. 3: A schematically side view drawing of an audio listening arrangement according to the disclosure.

Turning to FIG. 3, the ear support 120 comprises an upper elongated support portion 121 which extends substantially horizontally along a first elongated axis X1. The elongated support portion 121 has an end 122, which forms a first end 122 of the ear support 120. As shown, the loop 113 extends towards the first end 122 of the ear support 120. When the ear listening device 110 is worn by a wearer, the end 122 of the elongated support portion 121 points in direction of the back of the head of the wearer, i.e. away from the face of the wearer.

Figure 2:
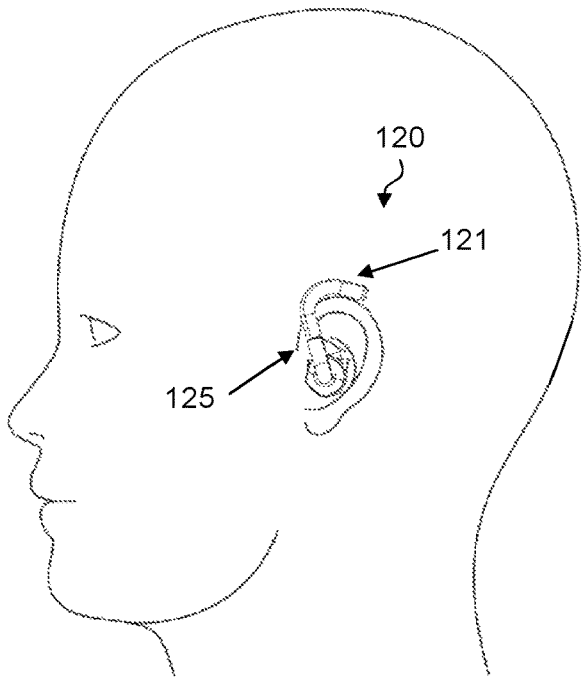
FIG. 2: A schematically side view drawing of a user wearing an audio listening arrangement according to the disclosure.

The elongated support portion 121 is adapted to be supported on the upper part of the ear of the user of the audio listening arrangement. By "upper part of the ear" of the user is meant the upper portion of the ear trumpet, more particularly the area where the upper portion of the ear trumpet is attached to the head of the user. FIG. 2 shows a side view of the head of a user wearing the audio listening arrangement according to the disclosure. In FIG. 2, the support portion 121 rests on the upper part of the ear of the user.

Returning to FIG. 3, the upper elongated support portion 121 is interconnected with an elongated leg 125 by means of a first bend B1. The elongated leg 125 thereby forms an acute angle V1 with the upper elongated support portion 121. For the function of the ear support 120 it is preferred that the elongated leg 125 forms an acute angle V1 with the support portion 121. One reason therefore is that the elongated leg 125 should extend upwards in front of the ear trumpet of the user to allow the bend B1 to partially surround the upper forward portion of the ear trumpet. The upper, substantially horizontal, support portion 121 may thereby rest comfortably on the upper part of the ear of the user (see FIG. 2). It is further believed that the acute angle V1 between the elongated leg and the upper support portion 121 of the ear support has an influence on the force by which the bend B1 of the ear support is pressed against the sides of the head of the user The angle V1 may for example be in the range of 80°-30° or 80°-40° or 80°-50° or 80°-60 or 80°-70° or 70°-30° or 70°-40° or 70°-50° or 70°-60° or 60°-30° or 60°-40° or 60°-50° or 50°-40° or 50°-30° or 40°-30°. Practical trials have shown that the bend B1 of the ear support is securely pressed against the sides of the head of the user when the size of the angle V1, V1' is in the range of 50°-70°, more preferred 50°-60°, most preferred 55°-65°.

The bend B1 is rounded, such that it has an arc shape. Preferably the bend B1 has a radius in the range of 7-12.5 mm when the angle V1 is in the range of 50°-70°. More preferred the bend B1 has a radius in the range of 7-9.5 mm when the angle V1 is in the range of 50°-60°, most preferred the bend B1 has a radius in the range of 8.5-11 mm when the angle V1 is in the range of 55°-65°. The radius of the bend B1 is carefully selected. When the radius is too small, the bend B1 will pinch the ear of the user which may be considered uncomfortable. When the radius is too large, the bend B1 will not fit sufficiently firmly around the forward portion of the ear trumpet of the user.

Figure 4:
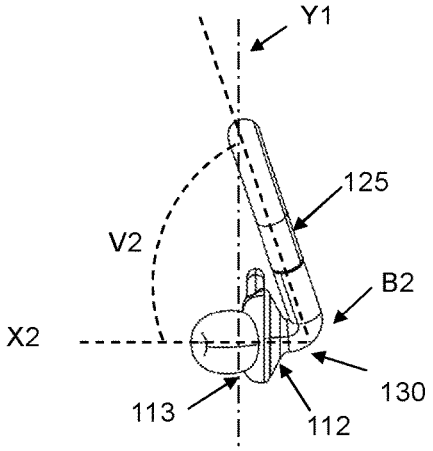
FIG. 4: A schematically front view drawing of an audio listening arrangement according to the disclosure.

Turning to FIG. 4, the ear support 120 comprises a second end 130 by which the ear support 120 is attached to the outer side 112 of the audio listening device 110. The ear support 120 may thereby be formed integrally, i.e. in one piece the audio listening device 110. Alternatively, the ear support 120 and the audio listening device 110 are discrete components that are attached to each other, for example by gluing, welding or form fitting.

The elongated leg 125 of the ear support 120 is attached to the outer side 112 of the audio listening device such that the elongated leg 125 is inclined in direction from the outer side 112 of the audio listening device 110 towards the inner side 111 of the audio listening device 110. More specifically, the elongated leg 125 of the ear support 120 is inclined towards a horizontal axis Y1 which extend parallel with the inner side 111 of the audio listening device 110. Since the elongated leg 125 of the ear support 120 is inclined towards the inner side 111 of the audio listening device 110 it forms an acute angle V2 with a horizontal longitudinal axis X2 which extends through the outer side 112 and the inner side 111 of the audio listening device 110.

It is important that the elongated leg 125 of the ear support 120 is inclined towards the inner side 113 of the audio listening device 110 to cause the first bend B1 between the upper elongated support portion 121 and the elongated leg of the ear support 120 to press against the sides of a head of the user of the audio listening arrangement. The degree of inclination, which is defined by angle V2 determines the force by which the upper support portion 121 presses against the head of a user and thereby the stability of the audio listening arrangement on the head of the user. The angle V2 may be in the range of 80°-50° or 80°-60 or 80°-70° or 70°-60° or 75°-65°. Practical trials have shown that the audio listening device 110 is held securely in place in the ear of the user when the angle V2 is in the range of 60°-80° more preferred 65°-75°. Practical trials further showed that an audio listening arrangement having an angle V2 in the preferred range was found to rest firmly and comfortably on the head of a user.

In FIG. 4, the end portion 130 of the ear support 120 is interconnected with the longitudinal leg 125 by a second bend B2 so that the elongated leg 125 and the end portion 130 forms the angle V2. This is advantageously since it thereby is possible to achieve a large inclination angle V2 of the ear support 120 towards the head of the user.

It is also possible to attach the end 130 of the elongated leg 125 directly onto the outer side 112 of the audio listening device 110.

Returning to FIG. 3, the ear support 120 of the audio listening arrangement 100 is preferably manufactured from tube material. Tube material is light weight and has the advantage that an electrical cord 140 from, e.g. a device for receiving wireless signals may extend through the hollow ear support 120 to a transducer in the audio listening device.

The ear support 120 is preferably manufactured from polymer material, for example a thermoplastic material. However, it is also possible to manufacture a portion of the ear support 120 of resilient material, such as an elastomeric material or a rubber material, in order to increase the flexibility of the ear support. Preferably at least the first bend B1 of the ear support 120 is manufactured from, i.e. comprises resilient material, such as rubber or a TPE material such as styrenic block polymers or polyolefins or elastomeric alloys or thermoplastic polyurethanes of thermoplastic copolyester or thermoplastic polyamides.

In addition to the bend B1 it is also possible to manufacture a section of the elongated leg 125 in a resilient material as disclosed above. Thus, the elongated leg 125 may comprise a leg section 127 of resilient material, which extends from first bend B1 towards the end portion 130 of the elongated leg 125. By also forming a section of the elongated leg in resilient material, the degree of flexibility between the support portion 121 and the elongated leg 125 is increased.

Although a particular embodiment has been disclosed in detail this has been done for purpose of illustration only, and is not intended to be limiting. In particular it is contemplated that various substitutions, alterations and modifications may be made within the scope of the appended claims. For example, the audio listening device may comprise a microphone (not shown in the drawings) which may be integrated in one of the ear supports of the audio listening device. The microphone may be adapted to be connected to a device for wireless exchange of electrical signals with a receiving unit such as a smart phone. Wireless communication is preferably by blue tooth.

Moreover, although specific terms may be employed herein, they are used in a generic and descriptive sense only and not for purposes of limitation. Furthermore, as used herein, the terms "comprise/comprises" or "include/includes" do not exclude the presence of other elements. Finally, reference signs in the claims are provided merely as a clarifying example and should not be construed as limiting the scope of the claims in any way.

What is claimed is:

1. An audio listening arrangement comprising an audio listening device configured to be placed in an ear of a user, wherein the audio listening device comprises an inner side configured to face the ear of the user and an outer side opposite to the inner side, and an ear support for holding the audio listening device in the ear of the user, wherein the ear support comprises:

an elongated substantially straight support portion extending along a first longitudinal axis and configured to rest on an upper part of an ear of a user; and an elongated leg having a first end and a second end, the second end interconnected with the elongated substantially straight support portion by a first bend such that the elongated leg forms an acute angle with the elongated substantially straight support portion, whereby the first end of the elongated leg is attached to and extends from the outer side of the audio listening device by an end portion that extends along a second longitudinal axis, the second longitudinal axis extending through the inner and outer sides of the audio listening device, such that the elongated leg is inclined in direction of the inner side of the audio listening device and is generally coplanar with the elongated substantially straight support portion.

2. The audio listening arrangement according to claim 1, wherein the elongated leg is inclined towards a vertical axis extending in parallel with the inner side of the audio listening device.

3. The audio listening arrangement according to claim 1, wherein the elongated leg forms an acute angle with the second longitudinal axis extending through the inner and outer sides of the audio listening device.

4. The audio listening arrangement according claim 1, wherein the end portion of the ear support is interconnected with the elongated leg by a second bend such that the elongated leg forms an acute angle with the end portion of the ear support.

5. The audio listening arrangement according to claim 1, wherein the end portion of the first end of the elongated leg is directly attached to the outer side of the audio listening device.

6. The audio listening arrangement according to claim 1, wherein the elongated substantially straight support portion has an end.

7. The audio listening arrangement according to claim 1, wherein said inner side of the audio listening device comprises an audio conductor configured to conduct acoustic signals from a transducer arranged in the audio listening device into the ear of the user.

8. The audio listening arrangement according to claim 1, wherein at least a portion of the inner side of the audio listening device is configured to be placed in contact with a concha of an ear of the user.

9. The audio listening arrangement according to claim 1, wherein at least the first bend comprises a resilient material.

10. The audio listening arrangement of claim 9, wherein the resilient material is a rubber material.

11. The audio listening arrangement according to claim 1, wherein the elongated leg comprises a first leg section extending from the first end towards the first bend and a second leg section extending from the first bend towards the first leg section, wherein at least the first leg section comprises a rigid material.

12. The audio listening arrangement according to claim 11, wherein the second leg section, the first bend and the elongated substantially straight support portion comprises a resilient material.

13. The audio listening arrangement of claim 12, wherein the resilient material is a rubber material.

14. The audio listening arrangement of claim 11, wherein the rigid material is a rigid polymer material.

15. The audio listening arrangement according to claim 1, wherein the audio listening device comprises a loop for abutment against the ear of a user.

16. The audio listening arrangement according to claim 1, wherein the ear support is tubular for receiving an end of a resilient cord.

17. The audio listening arrangement of claim 1, wherein the elongated leg is substantially straight.

18. The audio listening arrangement of claim 1, wherein the second end of the elongated leg is attached to and extends from a center location of the outer side of the audio listening device.

19. The audio listening arrangement of claim 1, wherein the elongated leg is configured to extend from the audio listening device and incline in a forward direction generally toward the user's face when the audio listening device is placed in the ear of the user.

20. An audio listening arrangement comprising:

an audio listening device comprising an inner side and an outer side, the inner side configured to produce sound and to face an ear of a user, an elongated leg extending from a first end to a second end, the first end of the elongated leg attached to the audio listening device such that the elongated leg is inclined in direction of the inner side of the audio listening device, and wherein the first end of the elongated leg is located adjacent the outer side and directly opposite the inner side of the audio listening device; and an elongated substantially straight support portion extending along a first longitudinal axis and configured to rest on an ear of the user, the elongated substantially straight support portion interconnected with the second end of the elongated leg by a first bend such that the elongated leg forms an acute angle with the elongated substantially straight support portion, and wherein the elongated leg is generally coplanar with the elongated substantially straight support portion.

* * * * *